United States Patent [19]

Lombardo

[11] Patent Number: 4,610,189

[45] Date of Patent: Sep. 9, 1986

[54] WEB PERFORATING UTILIZING A SINGLE PERF CYLINDER AND DUAL ANVILS

[75] Inventor: Leo Lombardo, Manchester, N.H.

[73] Assignee: Moore Business Forms, Inc., Grand Island, N.Y.

[21] Appl. No.: 753,900

[22] Filed: Jul. 11, 1985

[51] Int. Cl.[4] ..... B26F 1/20; B26F 1/24

[52] U.S. Cl. ..... 83/30; 83/346; 83/659; 83/660; 83/303

[58] Field of Search ..... 83/30, 405, 660, 687, 83/346, 659, 14, 347, 303

[56] References Cited

U.S. PATENT DOCUMENTS

| | | | |
|---|---|---|---|
| 3,074,303 | 1/1963 | Waters | 83/660 X |
| 3,135,152 | 6/1964 | Bedinghaus . | |
| 3,192,810 | 7/1965 | Amato . | |
| 3,255,651 | 6/1966 | Huck . | |
| 3,283,633 | 11/1966 | Finke et al. | 83/660 X |
| 3,347,123 | 10/1967 | Worner et al. . | |
| 3,682,028 | 8/1972 | Clayton et al. . | |
| 3,866,497 | 2/1975 | Wolfberg et al. . | |
| 4,074,599 | 2/1978 | Allen . | |
| 4,213,361 | 7/1980 | Kanervo . | |

*Primary Examiner*—Donald R. Schran

*Attorney, Agent, or Firm*—Cushman, Darby & Cushman

[57] ABSTRACT

In the perforation of webs, such as in the perforation of paper webs in the production of business forms, a single perforating cylinder is utilized in cooperation with two anvil cylinders. Perforating elements, such as interrupted blades, extend outwardly from the periphery of the perforating cylinder and are rotated into operative association with the web passing between a first anvil cylinder and the perforating cylinder, and a second anvil cylinder and the perforating cylinder, to form first and second sets of perforations spaced a predetermined desired amount along the web. The length of the web between the first and second anvil cylinders is adjustable to control precisely the spacing of the first and second sets of perforations along the web, as by passing the web over a compensator roller mounted between the first and second anvil cylinders and movable toward and away from the perforating cylinder. The web may be directed in an alternate path bypassing the second anvil cylinder when the second set of perforations is not necessary.

20 Claims, 3 Drawing Figures

WEB PERFORATING UTILIZING A SINGLE PERF CYLINDER AND DUAL ANVILS

BACKGROUND AND SUMMARY OF THE INVENTION

In conventional paper web perforating systems, and in conventional procedures for producing perforated business forms or the like from paper webs, when two sets of perforations are desired the web is passed over an anvil cylinder and perforating blades (or like perforating elements) on each of a pair of perforating cylinders which are rotated into contact with the web as it passes over the single anvil cylinder. When it is desired to adjust the spacing between the first and second sets of perforations formed by the perforating cylinders, it is necessary to adjust the position of one of the perforating cylinders with respect to the other perforating cylinder and the anvil cylinder. Such an adjustment is difficult and often imprecise. Utilizing such a conventional system and procedures, when the perforating blades must be periodically changed, two sets of blades (one associated with each set of perforating cylinders) must be replaced, resulting in a significant amount of down time at that particular point in time. Further, if it is desirable to use the system to form only a single set of perforations, one of the perforating cylinders must be moved out of operative association with the anvil cylinder.

According to the present invention an assembly and method are provided which overcome the drawbacks of the prior art system and procedures set forth above. In particular, according to the present invention a single perforating cylinder is utilized, and it is disposed in operative association with first and second anvil cylinders. All of the cylinders are rotatable about parallel, spaced axes, and the first and second anvil cylinders are mounted with respect to the perforating cylinder so that the web perforating elements (e.g. interrupted blades) extending outwardly from the perforating cylinder cooperate with the anvil cylinders so that a paper web passing between the perforating cylinder and one or both of the anvil cylinders is perforated thereby.

In the preferred embodiment of the assembly according to the invention, the spacing between the first and second sets of perforations formed in the web by cooperation between the perforating cylinder and the first and second anvil cylinders, respectively, is precisely controlled by adjusting the length of the web between the first, and second anvil cylinders. Preferably a compensator roller is provided over which the web passes, and the spacing of the compensator roller with respect to the perforating cylinder is adjusted by moving the axis of rotation of the compensator roller with respect to the perforating cylinder.

In addition to the compensator roller, various additional rollers are provided for directing the web in its path between the first and second anvil cylinders. Additionally, another roller, or other rollers, are provided so that the web may move in an alternate path in which after it passes between the first anvil cylinder and the perforating cylinder it bypasses the second anvil cylinder, so that only a single set of perforations is formed in the web. In all cases, the axes of the perforating cylinder and the first and second anvil cylinders remain stationary with respect to each other, and only the lighter, more easily controlled, compensator roller need be moved.

The invention also relates to a method of perforating a paper web in the production of business forms and the like utilizing a single perforating cylinder and first and second anvil cylinders, including precisely controlling the spacing of the sets of perforations formed in the web by cooperation between the perforating cylinder and the first anvil cylinder, on the one hand, and the perforating cylinder and the second anvil cylinder, on the other.

It is the primary object of the present invention to provide an apparatus and method for the simple, effective, and versatile perforation of a web, such as a paper web in the production of business forms. This and other objects of the invention will become clear from an inspection of the detailed description of the invention, and from the appended claims.

DETAILED DESCRIPTION OF THE DRAWINGS

Figure 1:
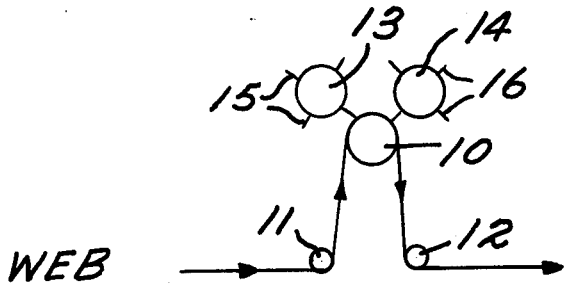
Fig. 1. (PRIOR ART)
FIG. 1 is a schematic side view representation of a conventional prior art system for forming two spaced sets of perforations in a moving web.

FIG. 1 shows a conventional prior art perforating assembly over which the invention is an improvement. The system illustrated in FIG. 1 is basically the same as that shown (in more detail) in prior U.S. Pat. No. 4,074,599, and comprises a single anvil cylinder 10 over which a web is directed by a pair of rollers 11, 12. First and second perforating cylinders 13, 14, respectively, cooperate with the anvil cylinder 10 to form two sets of perforations in the web, spaced along the length thereof. To adjust the spacing between the sets of perforations it is necessary to move the cylinder 14 with respect to the cylinders 10, 13. When it is necessary to change the perforating elements, all of the perforating elements 15 associated with the cylinder 13, and perforating elements 16 associated with the cylinder 14, are changed at the same time, resulting in significant down time at that point in time. When it is desirable to form only one set of perforations in the web, one of the cylinders 13, 14 must be moved out of operative association with the anvil cylinder 10.

Figure 2:
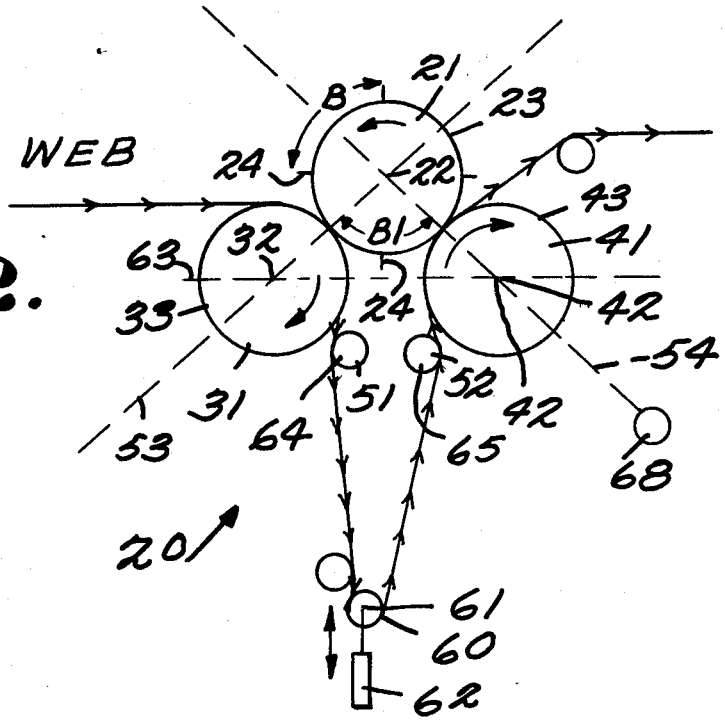
FIG. 2 is a schematic side view representation of an exemplary web perforating assembly according to the present invention as utilized in the production of a web with two sets of spaced perforations.
Figure 3:
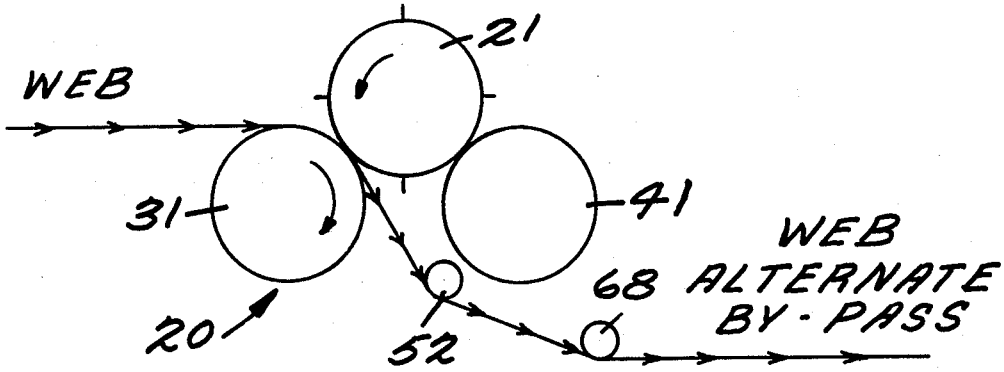
FIG. 3 is a view like FIG. 2 only showing the assembly when used to produce a web having a single set of perforations.

An exemplary web perforating assembly according to the present invention is shown generally by reference numeral 20 in FIGS. 2 and 3. The assembly 20 includes a single perforating cylinder 21. The cylinder 21 is rotatable about a first axis 22 and has a periphery 23 with web-perforating elements 24 operatively extending therefrom. The exact nature of the web perforating elements 24 will depend upon the types of perforations being formed in the web. Preferably the elements 24 comprise a plurality of sets of interrupted blades extending in-line parallel to the axis 22 along the periphery 23, such as disclosed in U.S. Pat. No. 4,074,599. In the preferred embodiment illustrated, four sets of elements 24 are provided, although virtually any number of sets of elements 24 regularly spaced from each other along the periphery 23 at angle B.

The assembly 20 also includes a first anvil cylinder 31 rotatable about a second axis 32 and having a periphery 33. The axis 32 is parallel to and spaced from the axis 22. The assembly 20 further comprises a second anvil cylinder 41 rotatable about a third axis 42, and having a periphery 43. The axis 42 is parallel to, and spaced from, the axes 22, 32. The exact construction of the anvil cylinders 31, 41 will depend upon the nature of the perforating elements 24. For instance when the perforating elements 24 are interrupted blades, such as shown in U.S. Pat. No. 4,074,599, the cylinders 31, 41 will have smooth, hardened peripheries 33, 43. Note that in the drawings the lengths of the elements 24 are exaggerated for clarity of illustration.

Also part of the assembly 20 are the first and second rollers 51, 52. These rollers comprise means for directing the web in a first path, as illustrated in FIG. 2, operatively between the first anvil cylinder 31 and the perforating cylinder 21, and then operatively between the second anvil cylinder 41 and the perforating cylinder 21. The cylinders 31, 41 are mounted with respect to the cylinder 21 so that two sets of spaced perforations are formed in the web when it passes in the first path illustrated in FIG. 2.

In the preferred embodiment illustrated in FIG. 2, note that the lines 53 and 54 passing between the axes 22, 32 and 22, 42, respectively, have an angle B1 therebetween. The angle B1 is preferably equal to, or an even multiple of, the angle B. For instance for the preferred embodiment illustrated in the drawings, the angles B and B1 are both 90° so that the first and second sets of perforations are formed in the web substantially simultaneously. Other configurations also may be provided depending upon the particular equipment utilized and results desired.

The assembly 20 also preferably comprises means for precisely controlling the predetermined desired spacing between the first and second sets of perforations formed along the web by controlling the length of the web between the cylinders 31, 41. Such web length control means preferably comprises a compensator roller 60 which is rotatable about a fourth axis 61 parallel to, and spaced from, the axes 22, 32, and 42. Means are provided, illustrated schematically by reference numeral 62 in FIG. 2, for moving the axis 61 of compensator roller 60 in a line toward and away from the axis 22, thereby adjusting the length of the web between the cylinders 31, 41. The structure 62 may comprise a pneumatic cylinder, or a wide variety of other conventional linear motion effecting means.

Note the position of the compensator roller 60 in FIG. 2 with respect to the first and second rollers 51, 52, and the axes of the cylinders 21, 31, 41. The compensator roller axis 61 is on the opposite side of a line 63 passing between the axes 32, 42 from the axis 21. Also the axis of rotation 64 (fifth axis of rotation) of the first roller 51 and the axis of rotation 65 (sixth axis of rotation) of the roller 52 are essentially in line with each other, and on the opposite sides of a line (not shown) passing between the axes 22, 61. The axes 64, 65 are also mounted on the opposite side of the line 63 from the axis 22.

When it is desired to utilize the assembly 20 to form only a single set of perforations in the web, instead of two sets of perforations (as when the web is passing in the first path illustrated in FIG. 2), the web is caused to pass in a second path, illustrated in FIG. 3. In the second path, the web bypasses the second anvil roller 41. In the second path, as the web passes from between the cylinders 21, 31 it passes into contact with the second roller 52 (instead of passing into contact with the first roller 51), and then passes into contact with another roller 68, which is on the same side of the line 63 as the roller 52.

As will be seen from an inspection of FIGS. 2 and 3, it is never necessary in normal operations to move the cylinders 21, 31, 41 with respect to each other. To adjust the spacing between the first and second sets of perforations it is necessary only to move the smaller, lighter, compensator roller 60. To use the same assembly 20 to form only a single set of perforations, it is necessary only to pass the web into operative association with the roller 68, rather than moving the cylinder 41. When it is necessary to change the elements 24 (on the single cylinder 21) need be changed at one time, resulting in less down time at that particular point in time.

While the invention has been specifically described with respect to two anvil cylinders cooperating with a single perforating cylinder, additional anvil cylinders could also be provided associated with the single perforating cylinder (e.g. four anvil cylinders disposed in pairs and for perforating two separate webs).

OPERATION

To form two sets of spaced perforations in a web, such as in the practice of a method of perforating a paper web in the production of business forms and the like, the web is caused to pass between a perforating cylinder 21 and a first anvil roller 31, around a compensator roller 60, and then between the perforating cylinder 21 and a second anvil roller 41. During rotation of the cylinders 21, 31, 41 about their axes, the perforating elements 24 operatively come into contact with the web at the areas thereof between the cylinders 21, 31, and 21, 41, respectively, to form two sets of perforations spaced from each other along the web. The exact spacing between the sets of perforations is controlled precisely and easily by adjusting the length of the web between the cylinders 31, 41, as by moving the axis 61 of compensator roller 60 with respect to the axis 22 of perforating cylinder 21. In the embodiment illustrated in FIG. 2, the two sets of perforations will be formed simultaneously since the angle B1 equals the angle B; however under some circumstances the angles B1 and B desirably would be made significantly different so that the perforations were not formed simultaneously.

When it is desired to use the assembly 20 to form only a single set of perforations in the web, the web is cut at a point between the rollers 51, and 60, and is rethreaded so that after passage between the cylinders 21, 31 it passes directly into engagement with the roller 52, and then into engagement with the roller 68, as illustrated in FIG. 3. In this second path of the web it bypasses the second anvil cylinder 41 so that only a single set of perforations is formed.

It will thus be seen that according to the present invention a simple and effective assembly and method have been provided for perforating a web. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent assemblies and methods.

What is claimed is:

1. A web perforating assembly comprising:

a perforating cylinder, comprising a cylinder rotatable about a first axis and having a periphery with web-perforating elements operatively extending therefrom;

a first anvil cylinder rotatable about a second axis, parallel to and spaced from said first axis;

a second anvil cylinder rotatable about a third axis, parallel to and spaced from both of said first and second axes;

said first and second anvil cylinders mounted with respect to said perforating cylinder so that said web perforating elements cooperate with said anvil cylinders so that a web passing between said perforating cylinder and one or both of said anvil cylinders is perforated by said perforating elements.

2. An assembly as recited in claim 1 wherein said first, second, and third axes are stationarily mounted with respect to each other.

3. An assembly as recited in claim 1 wherein said perforating elements comprise a plurality of sets of perforating elements, each set of perforating elements comprising a plurality of elements arranged in a straight line parallel to said first axis and along said perforating cylinder periphery and spaced from each other along said line; and wherein said sets of perforating elements are regularly spaced from each other around the periphery of said perforating cylinder.

4. An assembly as recited in claim 3 wherein said sets of perforating elements are arcuately spaced from each other B degrees; wherein a line perpendicular to each of said first and second axes makes an angle of approximately B1 degrees with a line perpendicular to both said first and third axes; and wherein B1=B, or an even multiple of B.

5. An assembly as recited in claim 4 further comprising roller means associated with said anvil cylinders for providing a first path of movement of a web between said first anvil cylinder and said perforating cylinder, and then between said second anvil cylinder and said perforating cylinder.

6. An assembly as recited in claim 5 further comprising additional roller means for providing for movement of a web in a second path between said first anvil cylinder and said perforating cylinder, and then away from said perforating cylinder and said second anvil cylinder, so that the web never comes into operative contact with the second anvil cylinder.

7. An assembly as recited in claim 5 further comprising adjustment means for adjusting the length of the web between said first anvil cylinder and said second anvil cylinder as the web moves in the first path, to thereby adjust the spacing between points along the web which are operatively engaged by said perforating elements when in operative association with said first anvil cylinder and said second anvil cylinder, respectively.

8. An assembly as recited in claim 7 wherein said web length adjustment means comprises a compensator roller rotatable about an axis parallel to and spaced from said first axis, and mounted on the opposite side of said second and third axes from said first axis; and means for moving the axis of said compensator roller toward and away from said first axis.

9. An assembly as recited in claim 1 further comprising roller means associated with said anvil cylinders for providing a first path of movement of a web between said first anvil cylinder and said perforating cylinder, and then between said second anvil cylinder and said perforating cylinder.

10. An assembly as recited in claim 9 further comprising adjustment means for adjusting the length of the web between said first anvil cylinder and said second anvil cylinder as the web moves in the first path, to thereby adjust the spacing between points along the web which are operatively engaged by said perforating elements when in operative association with said first anvil cylinder and said second anvil cylinder, respectively.

11. An assembly as recited in claim 10 wherein said web length adjustment means comprises a compensator roller rotatable about an axis parallel to and spaced from said first axis, and mounted on the opposite side of said second and third axes from said first axis; and means for moving the axis of said compensator roller toward and away from said first axis.

12. An assembly as recited in claim 11 further comprising additional roller means for providing for movement of a web in a second path between said first anvil cylinder and said perforating cylinder, and then away from said perforating cylinder and said second anvil cylinder, so that the web never comes into operative contact with the second anvil cylinder.

13. An assembly as recited in claim 11 wherein said first, second, and third axes are stationarily mounted with respect to each other.

14. A web perforating assembly comprising:

a perforating cylinder, comprising a cylinder rotatable about a first axis and having a periphery with web-perforating elements operatively extending therefrom;

a first anvil cylinder rotatable about a second axis, parallel to and spaced from said first axis;

a second anvil cylinder rotatable about a third axis, parallel to and spaced from said first and second axes;

said first, second, and third axes being mounted stationarily with respect to each other with said first axis disposed on a first side of a line extending between said second and third axes; and a compensator roller rotatable about a fourth axis parallel to, and spaced from, said first, second, and third axes, said fourth axis being disposed on a second side of said line, opposite said first side; and means for moving said fourth axis in a line toward and away from said first axis.

15. An assembly as recited in claim 14 further comprising first and second rollers, rotatable about fifth and sixth axes respectively, said fifth and sixth axes parallel to and spaced from said first, second, third, and fourth axes; said first roller being mounted adjacent said first anvil cylinder so that said fifth axis is on the second side of said line extending between said second and third axes, and said second roller mounted so that it is adjacent said second anvil cylinder with said sixth axis on the second side of said line extending between said second and third axes, said first and second rollers being disposed in line with each other on opposite sides of a line passing between said first and fourth axes.

16. A method of perforating a paper web in the production of business forms and the like, utilizing a perforating cylinder having a periphery with web-perforating elements operatively extending therefrom, and first and second anvil rollers mounted in operative relationship with the perforating cylinder, comprising the steps of continuously:

(a) passing the web between the peripheries of the first anvil and the perforating cylinder to form a first series of perforations along the paper web; and (b) passing the paper web from the first anvil cylinder to between the peripheries of the second anvil cylinder and the perforating cylinder so as to form a second series of perforations in the paper web spaced a predetermined desired distance from the first set of perforations.

17. A method as recited in claim 16 comprising the further step of (c) controlling the length of the web between the points of contact with the peripheries of the first anvil cylinder and the perforating cylinder, and the second anvil cylinder and the perforating cylinder, respectively, to thereby adjust and precisely control the distance between the first and second sets of perforations.

18. A method as recited in claim 17 wherein step (c) is practiced by: passing the web over a compensator roller, between the first and second anvil cylinders, the compensator roller rotatable about an axis parallel to the axis of rotation of the perforating cylinder; and adjusting the spacing of the compensator roller axis from the axis of the perforating cylinder.

19. A method as recited in claim 16 wherein steps (a) and (b) are practiced so that the first and second sets of perforations are formed in the web substantially simultaneously.

20. A method as recited in claim 16 comprising the further step of (d) selectively terminating the practice of step (b), and instead passing the web from between the first anvil cylinder and the perforating cylinder in a path which bypasses the second anvil cylinder.

* * * * *